United States Patent [19]

Anderson et al.

[11] 4,003,768

[45] Jan. 18, 1977

[54] METHOD FOR TREATING MAGNETIC ALLOY TO INCREASE THE MAGNETIC PERMEABILITY

[75] Inventors: Ronald L. Anderson, Mountain View, Calif.; Eugene E. Castellani, Putnam Valley, N.Y.; Patrick M. McCaffrey, Mahopac Falls, N.Y.; Lubomyr T. Romankiw, Briarcliff Manor, N.Y.

[73] Assignee: International Business Machines Corporation, Armonk, N.Y.

[22] Filed: Feb. 12, 1975

[21] Appl. No.: 549,401

[52] U.S. Cl. ..... 148/108; 148/31.55

[51] Int. Cl.[2] ..... C21D 1/04

[58] Field of Search ..... 148/108, 105, 103, 31.57, 148/100, 101, 31.55

[56] References Cited

UNITED STATES PATENTS

| | | | |
|---|---|---|---|
| 3,039,891 | 6/1962 | Mitchell | 148/108 |
| 3,117,896 | 1/1964 | Chu et al. | 148/108 |
| 3,409,479 | 11/1968 | Greenberg et al. | 148/108 |
| 3,472,708 | 10/1969 | Schindler et al. | 148/108 |
| 3,556,876 | 1/1971 | Pfeifer et al. | 148/108 |

*Primary Examiner*—Walter R. Satterfield

*Attorney, Agent, or Firm*—Pollock, Vande Sande & Priddy

[57] ABSTRACT

A method for increasing the magnetic permeability of a magnetic alloy having an easy axis and a hard axis which comprises subjecting a body of the magnetic alloy to a magnetic field of at least about 40 Gauss oriented in the direction of the hard axis while the body is maintained at a temperature at or above that required to deposit the alloy on a substrate.

17 Claims, 12 Drawing Figures

METHOD FOR TREATING MAGNETIC ALLOY TO INCREASE THE MAGNETIC PERMEABILITY

BACKGROUND OF THE INVENTION

The present invention relates to the treatment of magnetic materials to increase the magnetic permeability of the magnetic material. In particular, the present invention is concerned with increasing magnetic permeability by subjecting a magnetic material to certain magnetic fields oriented in the direction of its hard axis of magnetization.

The present invention finds particular applicability for fabricated magnetic articles such as those used in thin film recording heads, magnetic shields, bubble memory (domain) devices, and magnetic sensing devices. Magnetic devices such as thin recording heads and bubble memory devices and some magnetic shields employ magnetically anisotropic films which are obtained by electroplating, and/or evaporation, and/or sputtering of the magnetic material under the influence of an orienting magnetic field to form a film. The resulting film exhibits magnetic anisotropy in the plane of the film. The direction along which the orienting field is applied during the deposition process becomes the longitudinal, preferred, or easy axis of magnetization, while the direction in the plane of the film orthogonal to the easy direction becomes the transverse or hard axis.

In magnetic devices such as those mentioned above, it is generally desirable to have as high magnetic permeability as possible. Such devices have two stable states of magnetization. In order to switch such a device from a first state to its other stable state, a field is applied in one direction, and when the applied field is released the device reverses back to its original state.

The reversal of a magnetically anisotropic film or device to its original state usually takes place by so-called rotational switching technique, as opposed to domain wall motion. Domain wall motion is about an order of magnitude slower than rotational and is usually accompanied by the undesirable Barkhausen noise.

Rotational switching technique makes use of a magnetic field applied in the transverse direction in conjunction with the magnetic field in the preferred direction to produce a torque action on the regions of magnetic domain thereby creating a decrease in the time required to reverse the film or device.

In many magnetic devices it is desired to have highly permeable materials, which in thin film form are capable of supporting a very large magnetic flux at relatively high frequencies such as those frequencies at which the film switches by rotation. Accordingly, the present invention makes it possible to usually substantially increase permeability through the whole range of frequencies of about 0.1 MHz to about 100 MHz.

The present invention makes it possible, in some instances, to more than double the permeability of the hard or traverse axis without often encountering hard axis locking of the film. Moreover, the present invention makes it possible to change the permeability of the hard axis of fabricated magnetic devices of intricate design such as present in thin film magnetic recording heads and laminated magnetic shielding structures.

SUMMARY OF THE INVENTION

The present invention is directed to a method for increasing the magnetic permeability of a magnetic alloy having an easy axis and a hard axis, which includes:

A. subjecting a body of the magnetic alloy to a magnetic field of at least about 40 Gauss oriented in the direction of the hard axis; and B. maintaining the temperature of the body of magnetic alloy during step (A) at or above the temperature employed for depositing the magnetic alloy upon a substrate, the temperature being in the range between about 200° and about 500° C; provided that the body of magnetic alloy is not maintained at a temperature and for a time sufficient for causing the magnetic alloy to undergo recrystallization to such an extent as to lose its anisotropy.

DESCRIPTION OF PREFERRED EMBODIMENTS

Figure 1:
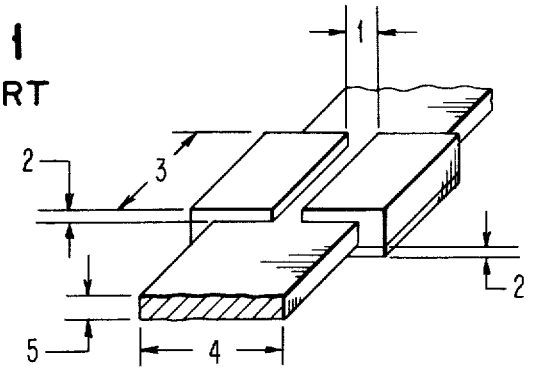
FIG. 1 PRIOR ART
FIG. 1 is a schematic representation of a prior art horizontal single-turn magnetic recording head which can be treated according to the method of the present invention.

The present invention is concerned with increasing the magnetic permeability of a body of a magnetic alloy and which has an easy axis and a hard axis, and is magnetically anisotropic in the plane of the film. The body of a magnetic alloy which is treated by the process of the present invention may comprise a magnetic material, particularly in the form of a film prepared by depositing a suitable ferromagnetic alloy on a substrate under the influence of an orienting magnetic field. The film may be deposited by such known means as evaporation, electroplating, electroless plating, sputtering, combinations of such means, or the like. The resulting film exhibits magnetic anisotropy with respect to one axis parallel to the plane of the film, the so-called "hard" axis and the method of the present invention operate to significantly increase the magnetic permeability.

Examples of some suitable magnetic films which can be treated by the process of the present invention include iron-silicon alloys which contain from a trace (i.e., about 0.01%) to about 12% by weight of silicon and preferably from about 3 to about 6% by weight of silicon; and nickel and iron alloys which contain from about 20 to 95% by weight nickel and from about 5 to 80% by weight iron. In addition, the nickel-iron alloys can contain up to a total of about 20% by weight of one or more other elements such as cobalt, copper, beryllium, manganese, molybdenum, titanium, silicon, chromium, and tungsten.

Exemplary of some alloys which can be played in the method of the present invention are 50% nickel and 50% iron alloy; 80% nickel and 20% iron alloy; 65% nickel and 35% iron alloy; 45% nickel, 25% cobalt and 30% iron alloy; 79% nickel, 17% iron and 4% molybdenum alloy; 78% nickel, 17% iron and 5% copper alloy; 79% nickel, 19% iron and 2% chromium alloy; 65% nickel, 25% iron and 10% manganese alloy; 43% nickel, 54% iron and 3% silicon alloy; 16% iron, 67% chromium, and 78% nickel alloy; and 94% iron and 6% silicon alloy.

The substrate upon which the film is deposited can be chosen from a variety of materials previously employed by those skilled in the art. For instance, the substrate may be glass, thermally grown $SiO_2$ on a Si wafer, sputtered $Al_2O_3$ and sapphire. Moreover, the substrate may be a non-magnetic metal or metal alloy such as copper, silver or gold. If desired, the above substrates can be coated with synthetic polymers such as polyimides, polysulfones, or photoresist polymers. Commercially available photoresist polymers are obtainable from Shipley Company, Inc. of Wellesley, Mass. and Eastman Kodak Company, Rochester, N.Y. One particular commercially available material is Shipley Resist 1350 which according to the manufacturer is a metacresol formaldehyde novalak resin sensitized with 2-diazo-L-oxy-1-naphthalene-5-sulfonic acid ester of 2,3,4-trihydroxy-benzophenone.

In addition, when used in thin-film magnetic recording heads, the above-mentioned substrates can be metallized for instance by evaporation of about 50–500 angstroms of an adhesion-promoting metal such as titanium, tantalum, chromium, or aluminum and about 200–1000 angstroms of copper, gold, or permalloy (80% nickel — 20% iron) before deposition of the magnetic material. Moreover, the magnetic films are processed to provide small gaps through the film such as about 1–12 $\mu$ wide gaps in preparing these films for use in the preparation of thin-film magnetic recording heads. Also, thin strips of, for instance, about 1 to about 12 $\mu$ width can be provided along the film to outline the regions of the thin-film magnetic recording head in order to facilitate etching.

The present invention is also particularly suitable for treating articles which have two magnetic films separated by a conductor and several dielectric layers such as in multi-turn inductive or integrated inductive magnetoresistive heads. In such instance, one of the films may be small (i.e., etched) while the other film may be in a large sheet form.

Each layer of magnetic material or film treated according to the present invention has a thickness of about 0.25 microns to about 5 microns and preferably from about 1 to about 4 microns.

The present invention is also particularly suitable for treating laminates which contain, for instance, a plurality of alternating layers of magnetic films and non-magnetic films and substrates of the type discussed hereinabove.

FIG. 1 is a schematic representation of a prior art horizontal single-turn magnetic recording head, the properties of which can be improved by treating the same according to the present invention. Numeral 1 identifies the gap in the recording head which can have a width, for instance, from about 0.5 to about 5 $\mu$. The magnetic film in the head, which film can be treated by the method of the present invention, has a thickness 2 which, in the particular recording head shown, can be from about 1 to about 4 $\mu$; and said film has a width 3 which, if desired, may be from about 10 to 500 $\mu$. The magnetic film is associated with a conducting lead, such as copper, gold, or aluminum having a width 4 and a thickness 5.

Figure 2:
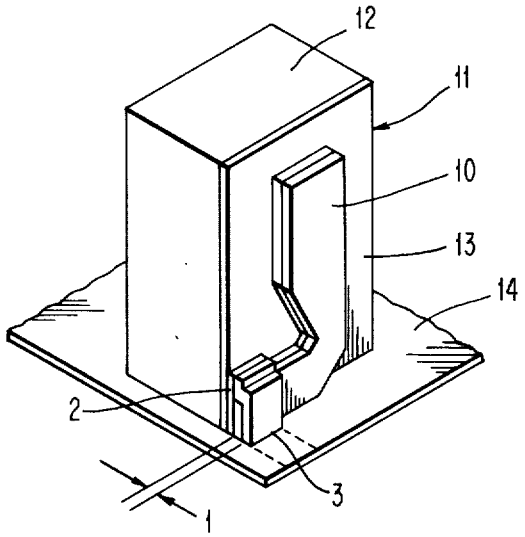
FIG. 2 PRIOR ART
FIG. 2 is a schematic representation of a prior art vertical single-turn magnetic recording head which can be treated by the method of the present invention.

FIG. 2 is a schematic representation of a prior art vertical single-turn magnetic head which can also be treated in accordance with the present invention. Numerals 1, 2, and 3 in FIG. 2 represent the same elements as in FIG. 1. Numeral 10 is a conductor lead, such as a copper, aluminum, or gold layer, for the magnetic film 2, 3. Numeral 11 represents the substrate for the recording head which, as shown in this instance, comprises a primary substrate 12 which may be fabricated of silicon supporting a layer 13 of another non-conducting material such as silicon dioxide ($SiO_2$). Numeral 14 represents the base for the recording head.

Figure 3:
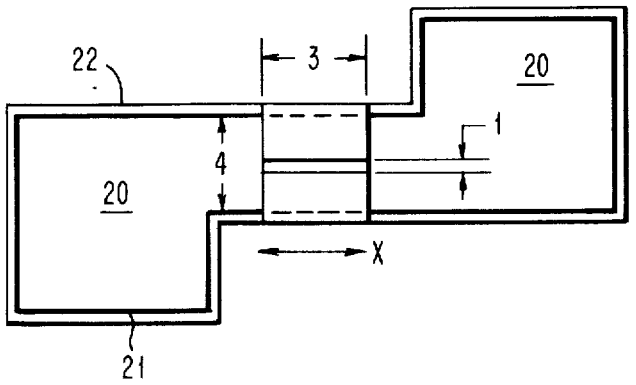
FIG. 3 PRIOR ART
FIG. 3 is a diagrammatic representation of a prior art single recording head pattern.

FIG. 3 is a schematic representation of a single-turn pattern for a recording head shown in FIG. 1. Numerals 1, 3 and 4 represent the same elements as described in FIG. 1. 20 represents contact pads for the recording head, 21 represents the conductor leads and 22 represents an additional magnetic layer such as an outer etched permalloy layer. X represents the magnetic easy axis of the magnetic layer. A more detailed discussion of the manner in which the above-described thin film magnetic recording heads can be obtained is found in IEEE Transactions on Magnetics, Vol. MA9–6, No. 3, September, 1970, pages 597–601, Romankiw et al, and "Batch Fabrication of Thin Film Magnetic Recording Heads", a literature review and process description for vertical single-turn heads, Romankiw et al, which was presented at the Intermag. Conference, April 1973 in Washington, D.C. as Abstract No. 15–2 and which will appear in IEEE Transactions on Magn. in January or February of 1975.

Figure 4:
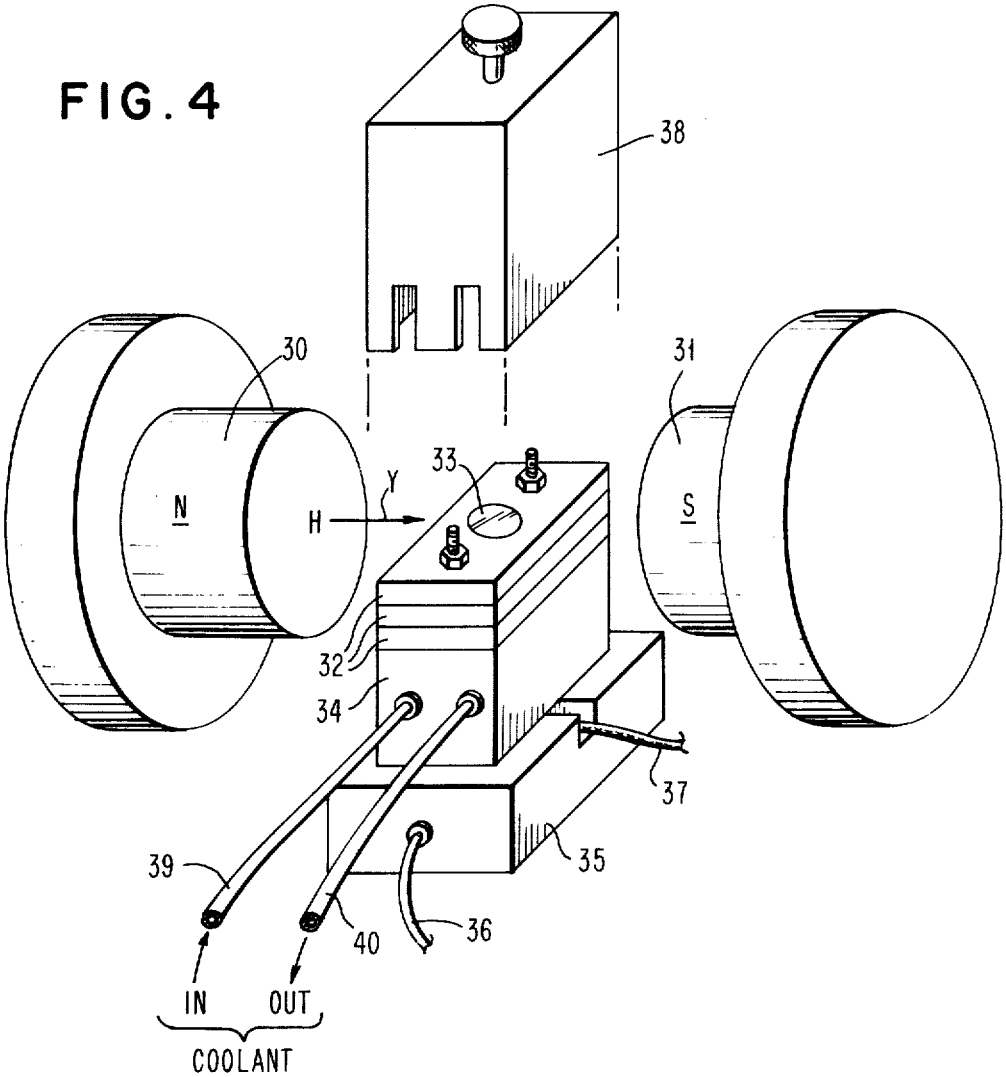
FIG. 4 illustrates diagrammatically an apparatus which can be employed to practice the method of the present invention.
Figure 4A:
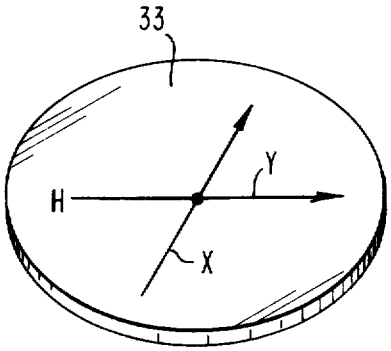
FIG. 4A illustrates a sample which can be treated in the apparatus of FIG. 4.

FIG. 4 illustrates apparatus which can be employed in carrying out the process of the present invention. Numerals 30 and 31 represent the north and south poles respectively of an electromagnet. Instead of an electromagnet, a pair of Helmholtz coils or a permanent magnet can be employed. Numeral 32 represents holders for samples to be subjected to the treatment of the present invention and 33 represents a sample to be treated. Several sample holders can be placed on top of each other. The sample holders are made of a metal which readily conducts heat and provides uniform temperature throughout the sample holders. Numeral 34 is a metal block which like the sample holders 32 is made of a metal which readily conducts heat and provides uniform temperature. Numeral 35 represents an electric heater and numeral 36 represents an electric lead to the heater 35. Numeral 37 represents a thermocouple to measure the temperature of the treatment and is connected to the sample holders 32, although not shown in the figure. Numeral 38 represents a cover which is placed over the sample during the treatment. Numerals 39 and 40 represent incoming and exiting conduits, respectively, for coolant such as air or water which is employed after the magnetic treatment is completed to help cool the sample to room temperature. Y represents the direction of the hard axis. FIG. 4A is an enlarged view of sample 33 shown in FIG. 4. X represents the direction of the easy axis and Y represents the direction of the hard axis.

The magnetic field to which the body of magnetic alloy is subjected in the practice of the present invention must be at least about 40 Gauss, and preferably is at least 100 Gauss. When the magnetic alloy is broken up by narrow gaps or strips of about 1 to 12 $\mu$ wide, the field must be at least about 100 Gauss, and preferably at least about 500 Gauss. The magnitude of the required magnetic field depends upon the relationship between the thickness and the lateral dimensions of the magnetic alloy. The magnitude of the necessary field increases as the lateral dimensions of the magnetic alloy being treated decreases and as the thickness of the alloy such as a film increases. The magnetic field is generally from about 40 to 5000 Gauss, preferably from about 100 to about 5000 Gauss, and most preferably from about 500 to about 5000 Gauss.

In general, the magnetic field employed must be greater than the sum of the demagnetizing field and coercive force of the particular article being treated. In particular, as the article gets more intricate and as the difference between, for instance, the lateral dimensions of the magnetic material and its thickness 2 diminishes, the magnetic field needed to increase the magnetic permeability increases. In general, when concerned with very thin film magnetic recording heads of intricate design, the magnetic film must be at least about 100 Gauss.

In order to accomplish the desired objects of the present invention, the magnetic field must be oriented along the hard axis of the magnetic material. Moreover, it has been observed that in addition to the hard axis treatment, it may be desirable at times to also include an easy axis magnetic treatment (stabilization) step before or after the hard axis magnetic treatment. However, the preferred process of the present invention is carried out without an easy axis magnetic treatment.

The temperature at which the article is maintained during the magnetic treatment should preferably be above that temperature which was employed and which is required to deposit the magnetic alloy on its substrate. However, the body of magnetic alloy should not be maintained at a temperature and for a time sufficient for causing the magnetic alloy to undergo recrystallization to such an extent as to lose its anisotropy.

Above the threshold temperature which could cause recrystallization for a given film, the amount or degree of recrystallization is dependent upon both temperature and time. At temperatures below that which could cause recrystallization (i.e., below 250° C for films deposited by evaporation, electrodeposition or electroless plating) the article can be heated for relatively long periods of time without adverse effect upon anisotropy.

In the temperature region in which recrystallization can occur, the higher the temperature, the shorter should be the time to avoid recrystallization and loss of anisotropy.

It has been observed that films of magnetic material deposited by evaporation, electrodeposition, or electroless plating can be treated at temperatures from about 200° to about 250° C, and above about 250° C to about 450° C depending upon the length of time of the treatment. If such films are treated at temperatures above this range or in excess of the predetermined time, rotation of the easy axis of the film occurs and produces concomitant reduction in its permeability as seen from FIG. 5, curve 4. At such higher temperatures, the films begin to exhibit partial hard axis locking along with reduction in the permeability.

However, when the magnetic alloy is applied by sputtering or high temperature evaporation during which the film surface temperature is much higher than employed in usual evaporation, electroless plating, and electrodeposition, the temperature of the magnetic treatment must be in the range between the surface temperature of the film during sputtering or high temperature evaporation and about 500° C. Usually the temperature is in the range between about 250° C and about 500° C and preferably in the range between about 400° and 450° C. Magnetic alloys which are applied by sputtering or high temperature evaporation contain iron and silicon or iron, nickel and molybdenum and/or chromium and/or tungsten and/or cobalt and/or beryllium and/or copper. Temperatures below the sputtering temperature would not provide any improvement in the permeability of such alloys.

The article is subjected to the aforementioned magnetic field at the aforementioned temperature for a time at least sufficient to increase the magnetic permeability but not sufficient for causing the magnetic alloy to undergo recrystallization to such an extent as to lose its antisotropy when the treatment temperature is above the threshold temperature which could cause recrystallization. The treatment time is primarily dependent upon the treatment temperature. The treatment time to a lesser extent is also dependent upon the strength of the magnetic field, size, shape, and composition of the magnetic material being treated; type of substrate employed; and the temperature, strength of magnetic field, and method used in depositing the magnetic material. Normally, the treatment is carried out for at least a few minutes (i.e., about 2 minutes) to about 6 hours depending on the temperature.

In particular, usually the treatment is carried out for at least about ½ hour to about 6 hours, and preferably about 1–½ to about 3 hours at treatment temperatures of about 200° to 250° C. At treatment temperatures of about 275° C to about 500° C, the treatment time is usually between about 2 minutes and ½ hour and preferably between about 2 minutes and about 15 minutes. It is understood that the treatment time when temperatures above recrystallization are used is the total time to which the article is subjected to such temperatures and includes the heating up time and time for cooling down to below recrystallization temperature.

The treatment according to the present invention usually does not require any particular type of atmosphere to successfully achieve the desired objectives. Normally, the treatment is conducted in air since such is the most convenient, simplest, and most economical manner in which to carry out the process. However, in those instances when the magnetic body or film is thinner than about 0.5 $\mu$ and the treatment temperature is greater than about 250° C, the magnetic treatment is preferably carried out in a non-oxidizing atmosphere such as in vacuum, an inert atmosphere such as nitrogen or argon; or in a reducing atmosphere such as a $H_2$ atmosphere or in a hydrogen-nitrogen atmosphere.

The article, once the magnetic treatment is completed, is permitted to cool down to room temperature which generally takes at least about ½ hour and usually up to about 2 hours. The time in which a particular article is cooled to room temperature will, of course, depend upon the specific structure and design of the article as well as upon the particular materials employed. It may be desirable, in some instances, to cool the article more quickly in order to increase production, and it may be possible to cool particular articles in about 10 to 15 minutes.

Also, it may be desirable to partially cool more quickly such as when the treatment temperature is above recrystallization temperature, the article may have to be quickly cooled to below the recrystallization temperature, and then can be slowly cooled to room temperature in order than the total time to which the article is subjected to above recrystallization temperatures is less than that which could cause loss of anisotropy.

However, the types of articles which are subjected to the treatment of the present invention should not be quickly cooled or quenched, i.e., cooled to room temperature in less than about 1 minute. The thermal shock of such quick cooling should possibly ruin the structure of the particular article causing delamination of various of the layers of the articles being treated by the process of the present invention. The cooling usually occurs in the presence of the magnetic field.

The present invention makes it possible to appreciably increase the magnetic permeability of the hard axis of a body which has an intricate shape.

The following nonlimiting examples, in which all parts are by weight unless the contrary is stated, are herein presented to further illustrate the present invention.

EXAMPLE 1

Part A

A 2 $\mu$ thick and 1.1 inch diameter electroplated permalloy film (81% nickel—19% iron) having a permeability of 1800 at 1 MHz is treated for 2 hours in air in a magnetic field of greater than 100 Gauss oriented along the hard axis while the film is maintained at a temperature of about 200° C. The film is then permitted to cool down to room temperature in about 1 hour. The permeability of the film at various frequencies is measured and found to be increased by a factor of 1.5 to 2 at 1 MHz, or 2700 to 3600. The 100 MHz permeability increases from about 320 to about 380.

Part B

Part A is repeated except that the annealing temperature is about 250° C. The permeability of the film during treatment at this temperature increases from about 2700 to about 4000 at 1 MHz. The 100 MHz permeability changes from 350 to 250.

Part C

Part A is repeated on the electroplated 2 $\mu$ thick film except that the temperature of the article during the magnetic treatment is about 275° C. The treatment at 275° C shows a decrease in the permeability of the hard axis of the film at all frequencies since the length of the treatment along with the temperature was sufficient to cause loss of anisotropy.

Figure 5:
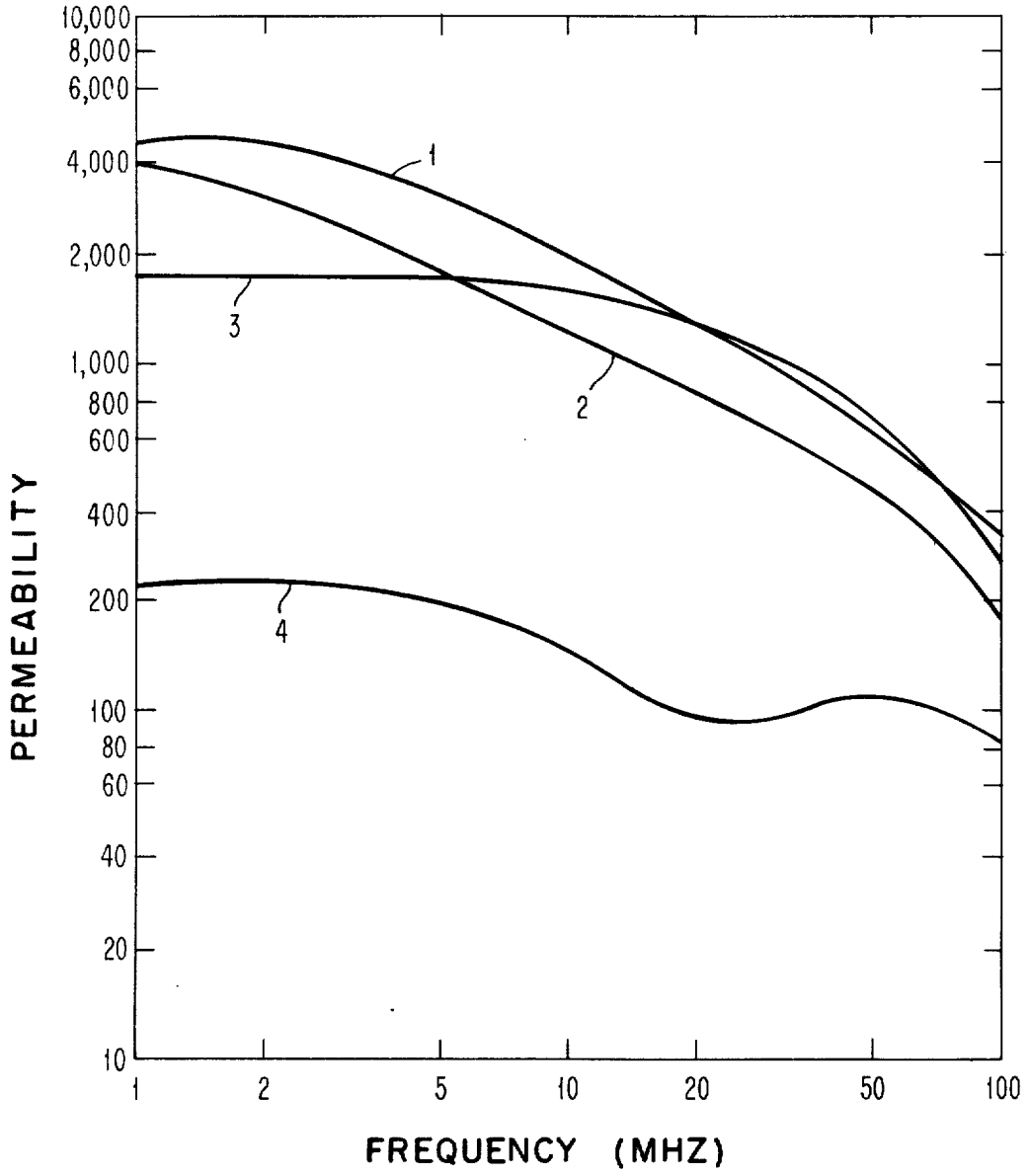
FIGS. 5 through 11 are curves illustrating the effect on certain properties by various magnetic field treatments.

The permeability of the hard axis of the treated films in Parts A–C, as measured at various frequencies, is shown in FIG. 5. Curve 1 in FIG. 5 demonstrates the permeability for various frequencies for treatment at 200° C. Curve 2 in FIG. 5 illustrates the permeability for various frequencies for the treatment at 250° C. Curve 4 illustrates the permeability at various frequencies for the treatment at 275° C. Curve 3 shows the permeability of the film in the as plated conditions prior to any treatment.

Part D

Part A is repeated on a fresh sample except that the 1.1 inch diameter article is initially subjected to an easy axis magnetic treatment at about 200° C for 2 hours in a 100 Gauss magnetic field prior to the hard axis magnetic annealing. The permeability of this article is measured at various frequencies and also the permeability of the same article is measured prior to any magnetic treatment at various frequencies.

Figure 6:
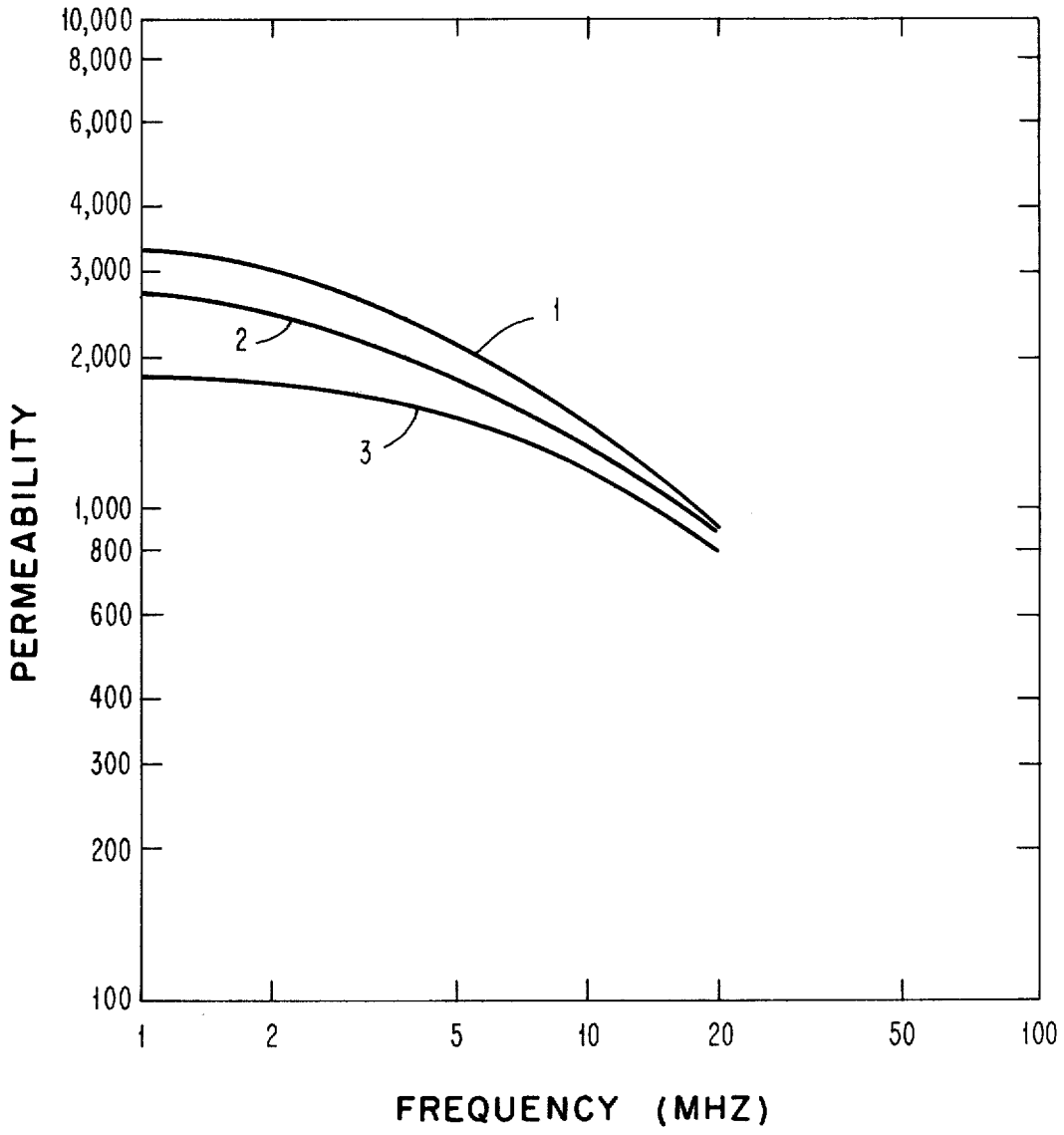

FIG. 6 illustrates the permeability at various frequencies of the article treated in Part A, Part D, and an article without any hard axis treatment. In particular, curve 1 of FIG. 6 shows the permeability of the article at the various frequencies for only hard axis magnetic treatment as in Part A; curve 2 illustrates the combination of easy axis magnetic treatment followed by hard axis annealing as in Part E; and curve 3 demonstrates the permeability at various frequencies prior to any hard axis magnetic treatment.

EXAMPLE 2

Part A

A laminated article containing 40 alternating layers of 500 angstroms thick permalloy films with 40 layers of 200 angstroms thick Schott glass prepared by evaporation of the permalloy at 150° C is subjected to a hard axis annealing for 2 hours in a 100 Gauss field at 225° C. After the magnetic treatment, the laminate is cooled down to room temperature in about 2 hours.

Part B

Part A is repeated except that the laminate is composed of 40 layers of 500 angstroms thick permalloy alternately laminated with 40 layers of 200 angstroms thick copper wherein the laminate is obtained by electroplating of the permalloy film.

Part C

Part A is repeated except that the laminate employed is a laminate of 40 layers of 500 angstroms thick permalloy film alternately laminated to 40 layers of 200 angstroms thick titanium films obtained by evaporation at 225° C of the permalloy film on $SiO_2$ or Si substrate.

Figure 7:
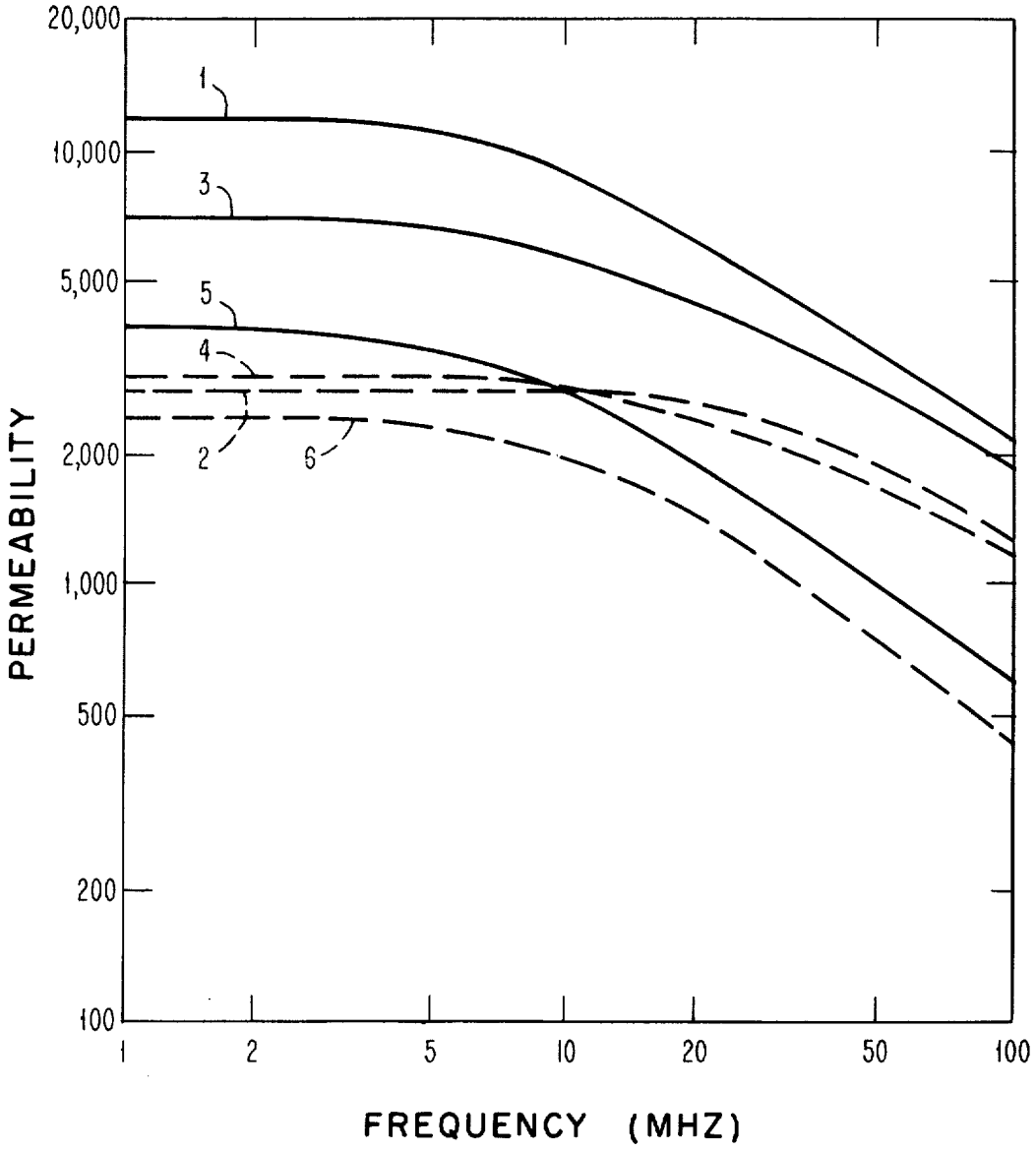

The results of permeability measurements at various frequencies are shown in FIG. 7. Curve 1 in FIG. 7 illlustrates the permeability at various frequencies of the laminate of Example 2A, which are subjected to the magnetic treatment, while curve 2 represents the laminate of Example 2A prior to the magnetic treatment step. Curve 3 represents the laminate of Example 2B which has been subjected to the magnetic treatment step while curve 4 represents the laminate of Example 2B prior to the magnetic treatment step. Curve 5 illustrates the permeability of the laminate of Example 2C after being subjected to the magnetic treatment process of the present invention whereas curve 6 represents the laminate of Example 2C prior to the magnetic treatment.

EXAMPLE 3

Figure 8:
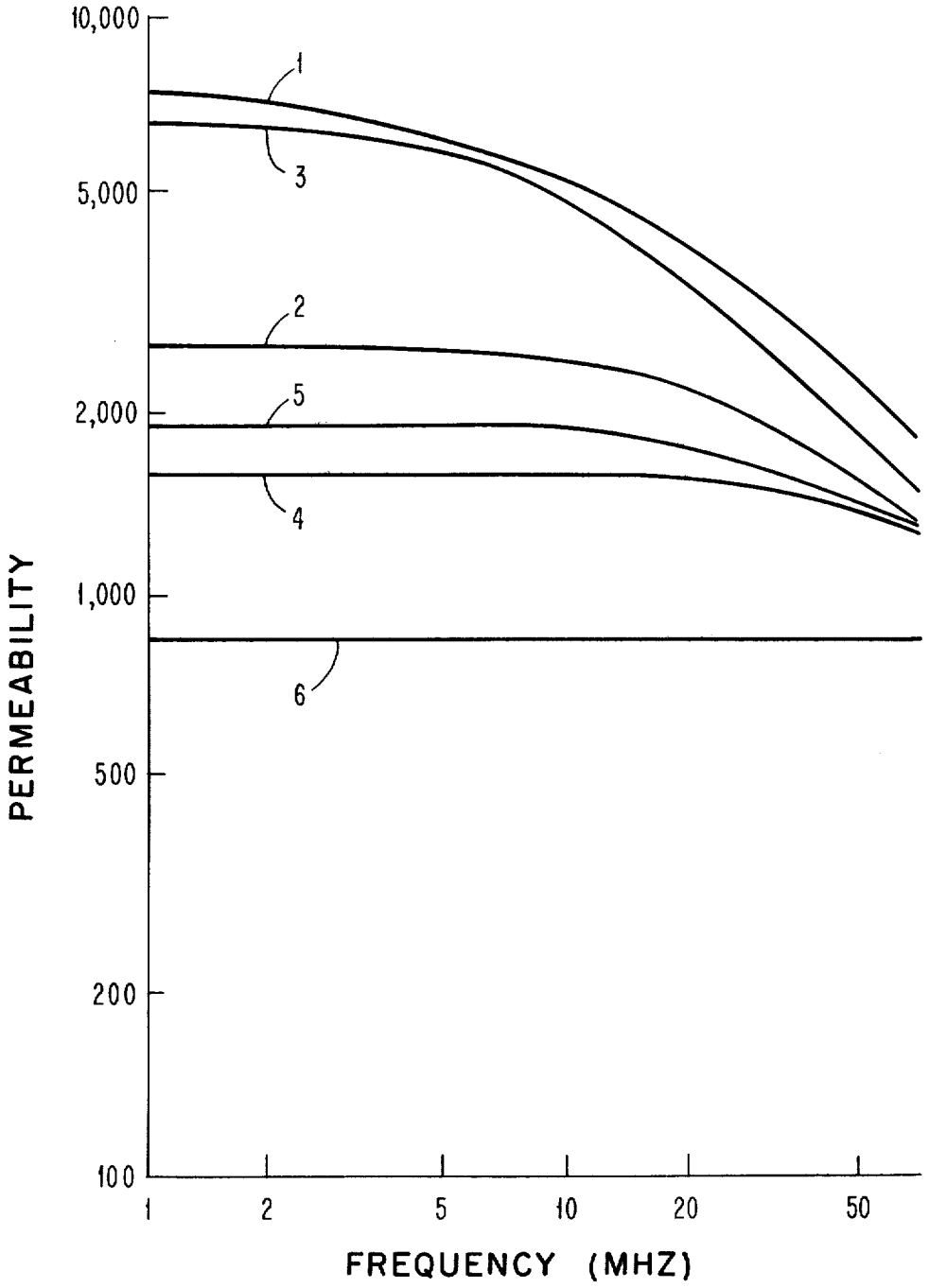

Laminates consisting of 5% copper permalloy, electroplated films of about 500 angstroms thick with alternating 250 angstroms thick layers of electroplated copper of varying thicknesses as illustrated in FIG. 8 are subjected to hard axis annealing for 2 hours in a 3000 Gauss field in air at 225° C. The laminates are cooled to room temperature in about 2 hours.

Curve 1 in FIG. 8 illustrates the permeability at various frequencies of a 1.8 micron total magnetic thickness laminate treated according to Example 3 and curve 2 and FIG. 8 illustrates the same laminate as in curve 1 prior to the magnetic treatment of the present invention. Curve 3 in FIg. 8 illustrates the permeability at various frequencies of a laminate of about 1.04 micron total magnetic film thickness subjected to the magnetic treatment of Example 3 while curve 4 in FIG. 8 illustrates the permeability of the same laminate as in curve 3 prior to the magnetic treatment process of the present invention. Curve 5 of FIG. 8 illustrates the permeability at various frequencies of an about 0.9 micron thick laminate treated according to the magnetic procedure of Example 3, and curve 6 illustrates the same laminate as shown in curve 5 but prior to any magnetic treatment according to the present invention.

EXAMPLE 4

A laminate of 40 layers of 500 angstroms thick permalloy deposited by evaporation at 150° C with alternating 40 layers of 100 angstroms thick titanium was annealed for 2 hours in a 3000 Guass field oriented in the direction of the hard axis in air at a temperature of 225° C.

The article is then subjected to a magnetic field of 300 Gauss in air for 2 hours at about 225° C with the field oriented in the direction of the hard axis. The laminate is then permitted to cool to room temperature.

Figure 9:
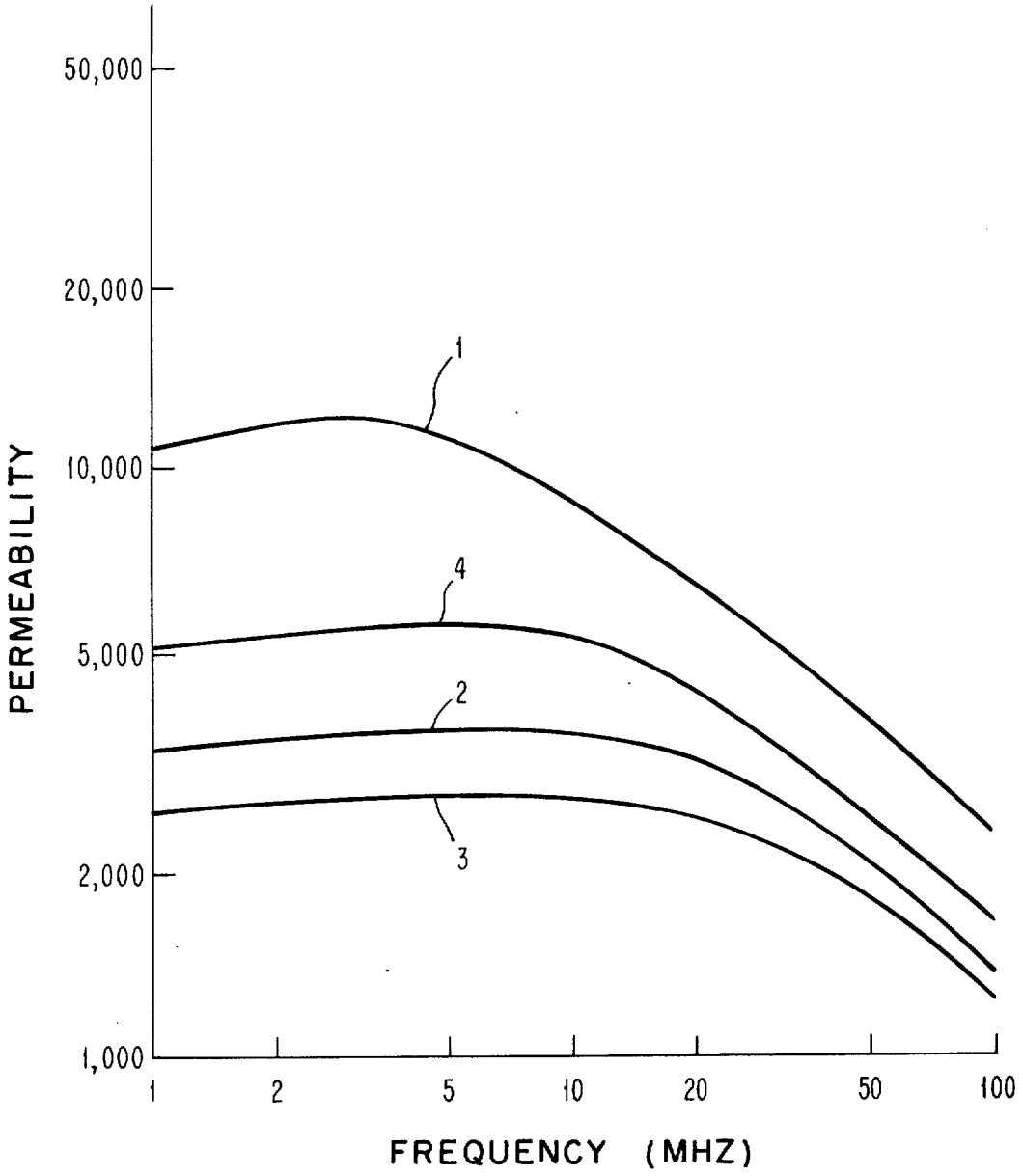

FIG. 9 illustrates the permeability measurements made at various frequencies for the above example. In particular, curve 1 in FIG. 9 illustrates the permeability at various frequencies of the laminate annealed at 225° C in the magnetic field oriented in the hard axis without the subsequent easy axis magnetic treatment. Curve 2 in FIG. 9 illustrates the permeability at various frequencies of the laminate which has been subjected to both the easy axis and hard axis magnetic treatment according to the above example. Curve 3 in FIG. 9 illustrates the permeability at various frequencies for the laminate of Example 5 which was not subjected to the magnetic treatment of the example.

EXAMPLE 6

Figure 10:
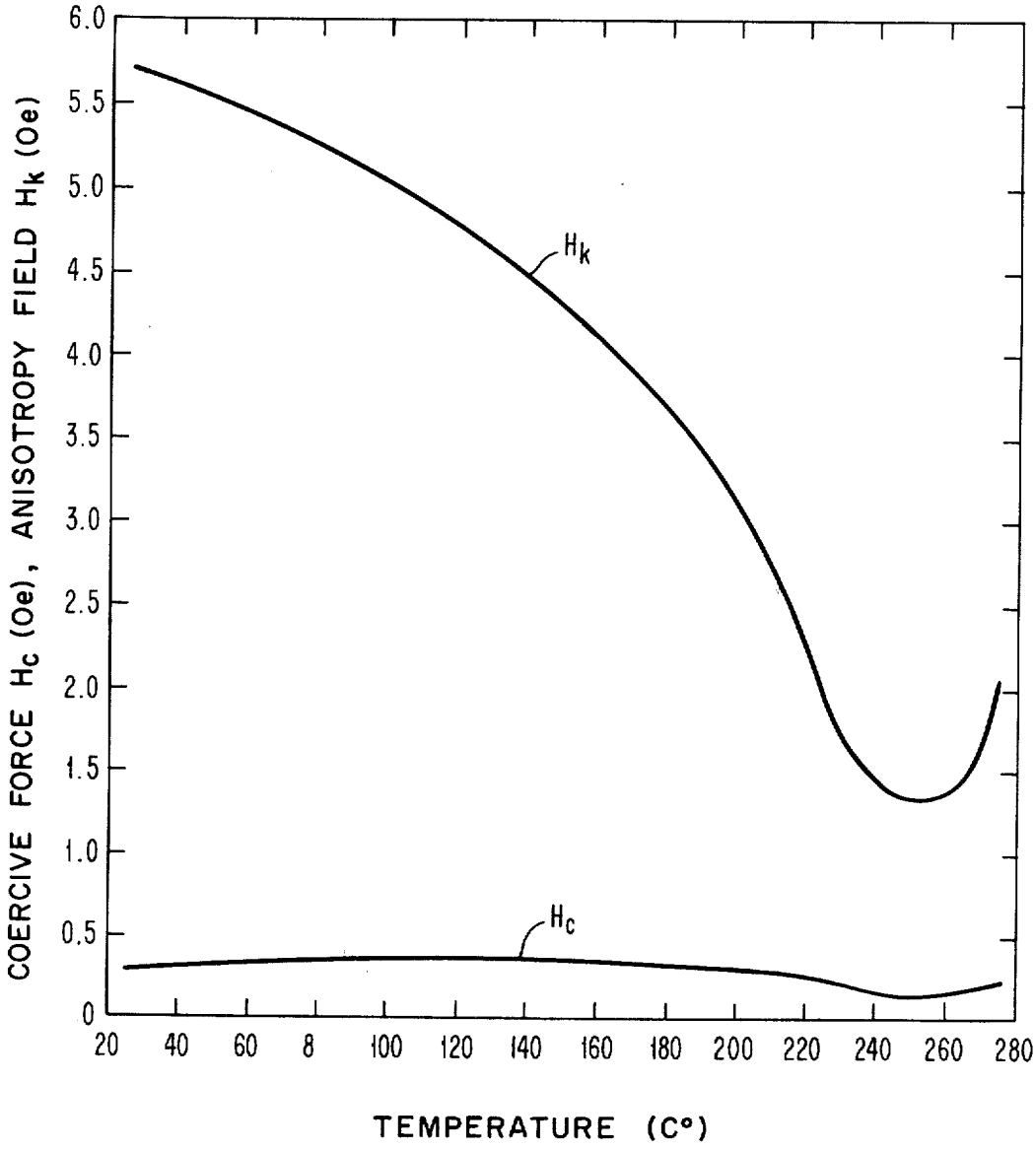
Figure 11:
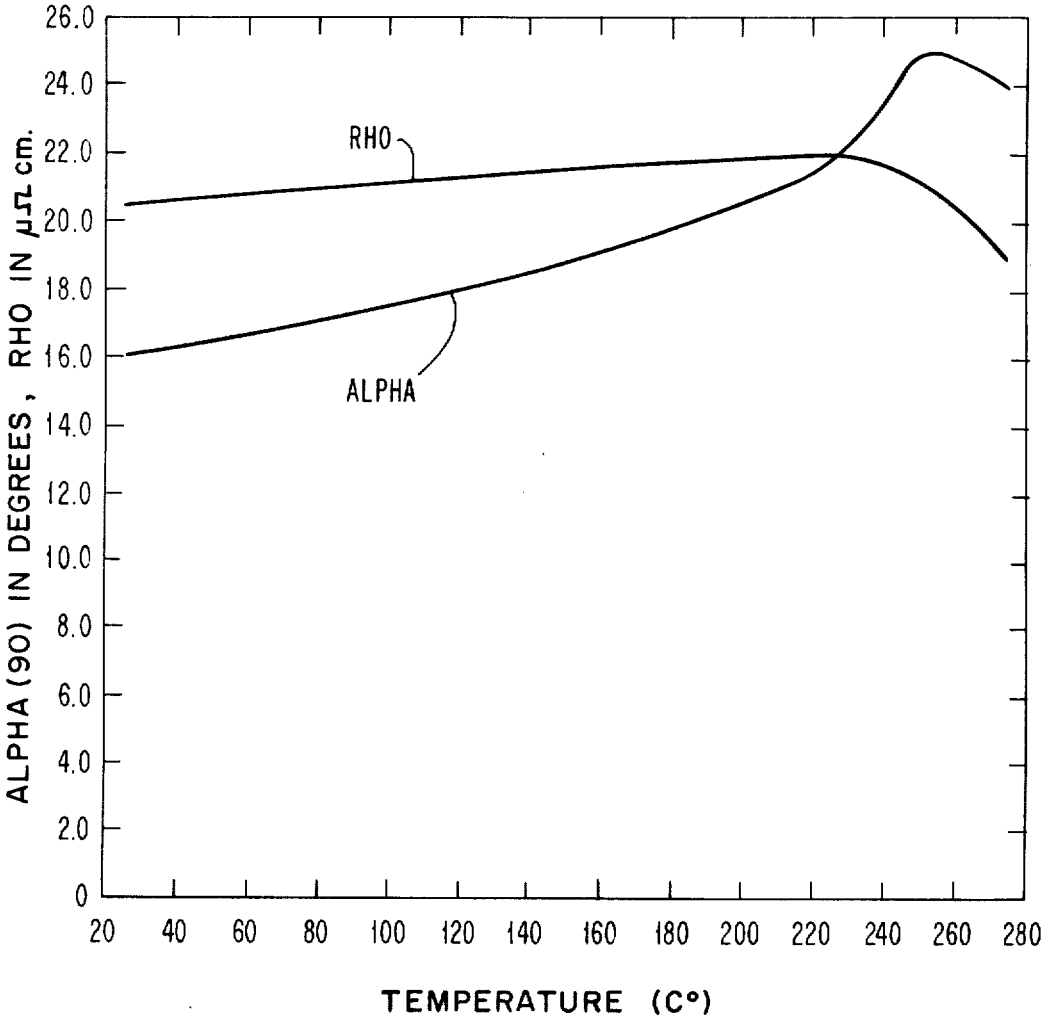

A 2 $\mu$ thick film of electroplated permalloy is annealed for 2 hours at a 3000 Gauss field oriented in the direction of the hard axis at progressively higher temperatures from room temperature to 275° C. The permeability of the article is measured at various frequencies and at the various temperatures, and measurement for Hc, Hk, $\alpha$ (angular dispersion of the easy axis) and $\rho$ the magnetic resistivity for the different temperatures are plotted in FIGS. 10 and 11. As noted from these figures, the maximum desired temperature to be employed for this type of film and for the treatment time appears to be about 250° C.

As observed from the various examples and from the figures demonstrating the permeability measurements, it is quite apparent that the process of the present invention greatly increases the permeability and in most cases increases it for the entire range of frequencies tested.

What is claimed is:

1. A method of increasing the magnetic permeability of a body of magnetic alloy having an easy axis and a hard axis, and containing from about 20 to 95% by weight of nickel, from about 5 to 80% by weight of iron, and up to 20% by weight of an element selected from the group consisting of copper, manganese, molybdenum, titanium, silicon, chromium, beryllium and tungsten wherein said body of magnetic alloy has a thickness of from about 0.25 to about 5 microns and is a film containing in the lateral plane 1–12 $\mu$ wide gaps in the magnetic material which comprises:

a. subjecting said body to a magnetic field greater than the sum of the demagnetizing field and coercive force of said body and being at least about 100 Gauss oriented along said hard axis;

b. said body being maintained during step (a) at or above the temperature needed to deposit the magnetic alloy on a substrate, wherein said temperature is in the range between about 200° and below about 250° C; provided however, that the body of magnetic alloy is not maintained at a temperature and for a time sufficient for causing the magnetic alloy to undergo recrystallization to such an extent as to lose its anisotropy and further provided said body is subjected to the magnetic field for about ½ hour to about 6 hours.

2. The method of claim 1 wherein said magnetic field is from about 500 to about 5000 Gauss.

3. The method of claim 1 wherein the body is subjected to the magnetic field for about 1½ hours to about 3 hours.

4. The method of claim 1 which further comprises cooling the body to about room temperature for at least about ½ hour.

5. The method of claim 1 wherein the subjecting of said body to said magnetic field is in air.

6. The method of claim 1 which further includes magnetic treatment along the easy axis.

7. The method of claim 2 wherein said body is subjected to the magnetic field for about 1½ hours to about 3 hours in air, and which further comprises cooling said body from the temperature of the subjecting to the magnetic field to about room temperature for at least about ½ hour.

8. The method of claim 1 wherein said body of magnetic alloy has a thickness of from about 1 to about 4 microns.

9. A method of increasing the magnetic permeability of a body of magnetic alloy having an easy axis and a hard axis, and containing from about 20 to 95% by weight of nickel, from about 5 to 80% by weight of iron, and up to 20% by weight of an element selected from the group consisting of copper, manganese, molybdenum, titanium, silicon, chromium, beryllium and tungsten wherein said body of magnetic alloy has a thickness of from about 0.25 to about 5 microns and is a film containing in the lateral plane 1–12 $\mu$ wide gaps in the magnetic material which comprises:

a. subjecting said body to a magnetic field greater than the sum of the demagnetizing field and coercive force of said body and being at least about 100 Gauss oriented along said hard axis;

b. said body being maintained during step (a) at or above the temperature needed to deposit the magnetic alloy on a substrate, wherein said temperature is in the range between about 250° and about 500° C; provided however, that the body of magnetic alloy is not maintained at a temperature and for a time sufficient for causing the magnetic alloy to undergo recrystallization to such an extent as to lose its anisotropy and further provided said body is subjected to the magnetic field for about 2 minutes to about 30 minutes.

10. The method of claim 9 wherein said temperature is in the range between about 400° and 450° C.

11. The method of claim 9 wherein said body is subjected to a magnetic field for between about 2 and about 15 minutes at a temperature of from about 275° C to about 450° C.

12. The method of claim 9 wherein said magnetic field is from about 500 to about 5,000 Gauss.

13. The method of claim 9 wherein said body is a laminate of alternating layers of a nonmagnetic material and a magnetic alloy containing nickel and iron.

14. The method of claim 9 which further comprises cooling the body to about room temperature for at least about ½ hour.

15. The method of claim 9 wherein the subjecting of said body to said magnetic field is carried out in a nonoxidizing atmosphere.

16. The method of claim 9 which further includes magnetic treatment along the easy axis.

17. The method of claim 12 wherein said body is subjected to the magnetic field for between about 2 and about 15 minutes at a temperature of from about 275° C to about 450° C in a nonoxidizing atmosphere, and further comprises cooling said body from the temperature of the subjecting to the magnetic field to about room temperature for at least about ½ hour.

* * * * *

UNITED STATES PATENT AND TRADEMARK OFFICE

CERTIFICATE OF CORRECTION

PATENT NO. : 4,003,768

DATED : January 18, 1977

INVENTOR(S) : Ronald L. Anderson et al

It is certified that error appears in the above-identified patent and that said Letters Patent are hereby corrected as shown below:

Column 2, line 65, change "played" to -- employed --.

Column 9, line 1, change "Flg." to -- FIG. --.

Signed and Sealed this

Sixth Day of June 1978

[SEAL]

*Attest:*

RUTH C. MASON
*Attesting Officer*

DONALD W. BANNER
*Commissioner of Patents and Trademarks*